US007823751B2

(12) United States Patent
Ophardt et al.

(10) Patent No.: US 7,823,751 B2
(45) Date of Patent: Nov. 2, 2010

(54) DUAL COMPONENT DISPENSER

(75) Inventors: Heiner Ophardt, Vineland (CA); Ali Mirbach, Issum (DE)

(73) Assignee: Hygiene-Technik Inc., Beamsville, Ontario (CA)

( * ) Notice: Subject to any disclaimer, the term of this patent is extended or adjusted under 35 U.S.C. 154(b) by 0 days.

(21) Appl. No.: 12/654,568

(22) Filed: Dec. 23, 2009

(65) Prior Publication Data

US 2010/0102089 A1 Apr. 29, 2010

Related U.S. Application Data

(63) Continuation of application No. 11/076,454, filed on Mar. 10, 2005, now Pat. No. 7,661,561.

(30) Foreign Application Priority Data

Mar. 19, 2004 (CA) ..... 2461430
Apr. 20, 2004 (CA) ..... 2464905

(51) Int. Cl.
*B65D 35/28* (2006.01)

(52) U.S. Cl. ..... 222/137; 222/136; 222/145.3; 222/190

(58) Field of Classification Search ..... 222/94, 222/135–137, 145.3, 180–181.3, 185.1, 190, 222/321.7–321.9, 325, 340, 383.1, 383.3, 222/385

See application file for complete search history.

(56) References Cited

U.S. PATENT DOCUMENTS

| | | | | |
|---|---|---|---|---|
| 2,680,010 | A | 6/1954 | Dubay | |
| 3,598,290 | A | 8/1971 | Steiman | |
| 3,645,904 | A | 2/1972 | Beach | |
| 4,004,716 | A | 1/1977 | Steels | |
| 4,103,876 | A | 8/1978 | Hasselman et al. | |
| 4,508,634 | A | 4/1985 | Elepano et al. | |
| 4,673,526 | A | 6/1987 | Zabotto et al. | |
| 4,715,517 | A | 12/1987 | Potter et al. | |
| 5,165,577 | A | 11/1992 | Ophardt | |
| 5,282,552 | A | 2/1994 | Ophardt | |
| 5,373,970 | A | 12/1994 | Ophardt | |
| 5,389,167 | A * | 2/1995 | Sperber | 156/71 |
| 5,441,666 | A | 8/1995 | Dotolo | |
| 5,445,288 | A | 8/1995 | Banks | |
| 5,507,573 | A | 4/1996 | Hiorth | |
| 5,839,610 | A | 11/1998 | Reese | |
| 5,857,591 | A | 1/1999 | Bachland | |
| 5,862,959 | A | 1/1999 | King | |
| 5,918,771 | A | 7/1999 | van der Heijden | |
| 6,082,586 | A | 7/2000 | Banks | |
| 6,394,316 | B1 | 5/2002 | Daansen | |
| 6,409,050 | B1 | 6/2002 | Ophardt et al. | |

(Continued)

FOREIGN PATENT DOCUMENTS

| | | |
|---|---|---|
| DE | 19513877 | 10/1996 |

(Continued)

*Primary Examiner*—J. Casimer Jacyna
(74) *Attorney, Agent, or Firm*—Riches, McKenzie & Herbert LLP

(57) ABSTRACT

A method and apparatus for extruding the first fluid capable of foaming through a porous member to produce a first foamed extrudate while simultaneously dispensing a second flowable material preferably containing particulate matter adjacent the first extrudate.

16 Claims, 9 Drawing Sheets

U.S. PATENT DOCUMENTS

| | | | |
|---|---|---|---|
| 6,506,262 | B2 | 1/2003 | Strout et al. |
| 6,634,524 | B1 | 10/2003 | Helmenstein |
| 6,706,518 | B2 | 3/2004 | Lorenz et al. |
| 6,820,819 | B2 | 11/2004 | Sperber |
| 7,222,802 | B2 | 5/2007 | Sweeton |
| 2007/0289997 | A1 | 12/2007 | Lewis et al. |

FOREIGN PATENT DOCUMENTS

| | | |
|---|---|---|
| EP | 1537916 | 8/2005 |
| FR | 1132821 | 3/1957 |
| JP | 57195630 | 12/1982 |
| WO | WO 97/27947 | 8/1997 |

* cited by examiner

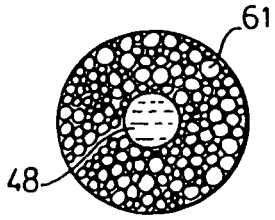
FIG.3.
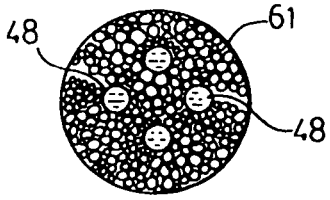
FIG. 4.
FIG.5.
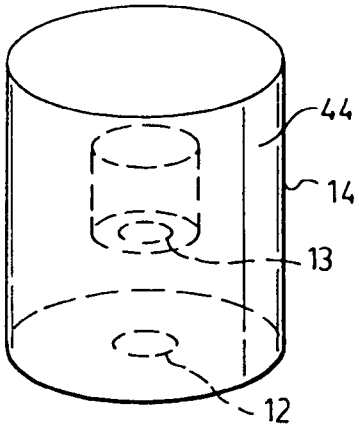
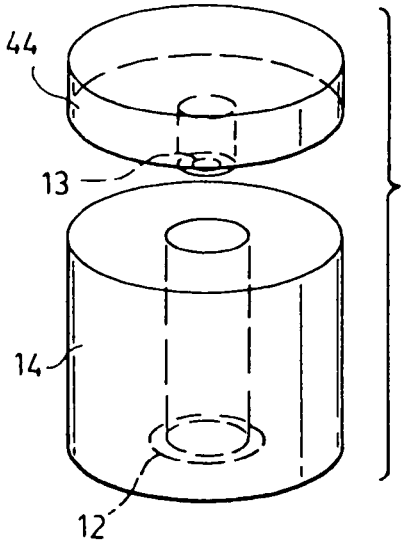
FIG. 6.
FIG.7.
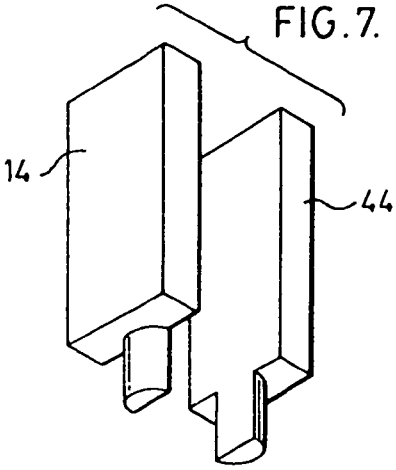
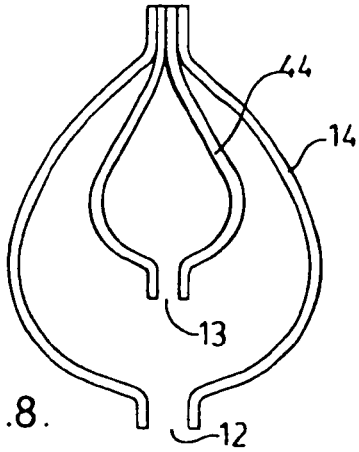
FIG.8.

DUAL COMPONENT DISPENSER

RELATED APPLICATIONS

This application is a continuation of U.S. patent application Ser. No. 11/076,454 filed Mar. 10, 2005 now U.S. Pat. No. 7,661,561 and claims the benefit of 35 U.S.C. 120.

SCOPE OF THE INVENTION

This invention relates to dispensers for producing and dispensing a product stream comprising two components one of which, preferably, includes either particulate matter or a high viscosity fluid.

BACKGROUND OF THE INVENTION

Fluids such as cleaning fluids and hand cleaners are known which include particulate solid material. Such fluids include fluids such as grit-laden or granular hand soap or lotions. Insofar as the particulate material may be large or heavier particles, then the grit-laden fluids may suffer the disadvantage that the particles settle out providing inconsistencies in composition and reduced shelf life. Settling may be reduced to some extent by including a gelling agent, however, such gelling agents are frequently disadvantageous as they typically increase the viscosity of the fluid.

The particulate solid materials may include grit and pumice. Grit is any granular material, preferably sharp, in relatively fine size as may be used as an abrasive. Pumice is a volcanic glass which is full of cavities and very light weight and may be provided as different sized particles to be used as an abrasive and absorption in cleaners.

Other particulate solid matter includes plastic synthetic resins scrubber particles such as disclosed in U.S. Pat. No. 3,645,904, cellulose abrasives such as wood flour, ground sponge, ground cork and sawdust as disclosed in U.S. Pat. No. 4,508,634, and finely divided silica such as blown fines of silica as disclosed in U.S. Pat. No. 4,673,526.

Grit laden fluids are typically provided with the grit incorporated in the fluid ready for use. Known dispensers do not provide for dispensing grit or other particulate matter independently of a fluid and combining the grit and fluid after dispensing. Thus, known dispensers are not useful for dispensing quantities of particulate matter and fluids which preferably are to be kept separated prior to use.

Known dispensers which produce foam pass a mixture of air and liquid through a foam-inducing device which typically is a porous member having small apertures. Passing the air and liquid mixture through the apertures or pores aids foam production by subjecting the mixture to turbulent flow conditions. The foam inducing porous member may be, for example, plastic or ceramic porous materials or a mesh or screen fabricated of criss-crossing metal or plastic wires, or a cloth material.

Many fluids to be dispensed include particulate matter which, if passed through known foam inducing devices, will clog the apertures or pores of these devices rendering the devices inoperative. Similarly, high viscosity fluids are not suitable for flowing through the small apertures or pores of foam inducing devices as the pressure required for adequate flow is not within normal operating conditions.

Known dispensers do not permit dispensing of fluids incorporating particulate matter or high viscosity fluids in a manner to provide a foamed product.

Known devices for producing foam include the present applicant's U.S. Pat. No. 6,409,050 to Ophardt et al., issued Jun. 25, 2002, U.S. Pat. No. 5,445,288 to Banks, issued Aug. 29, 1995 and U.S. Pat. No. 6,082,586 to Banks, issued Jul. 4, 2000, the disclosures of which are incorporated herein by reference.

Known devices do not provide simple constructions for pump assemblies which provide for dispensing two components which are to be kept separate until dispensed.

SUMMARY OF THE INVENTION

To at least partially overcome these disadvantages of previously known devices the present invention provides a method and apparatus for extruding a first fluid to produce a first extrudate while simultaneously dispensing a second flowable material preferably including particulate matter. Preferably, the first fluid is capable of foaming and is extruded through a porous member to provide the first extrudate as a foam. The second flowable material may be a fluid or flowable particulate matter.

The present invention in one aspect provides a method of dispensing foam which involves providing a first reservoir with a first fluid capable of foaming and a second reservoir of a second flowable material, preferably, dry particulate matter or particulate matter in a fluid. The method involves passing the first fluid together with air through a porous member to produce and extrude to an outlet an intermediate product including foam. The method also involves simultaneously dispensing the second flowable material to the outlet without passing the second flowable material through the porous member thereby producing a final product comprising the intermediate product including foam and the second flowable material. Preferably, the second flowable material is selected from a fluid comprising particulate solid matter which is incapable of passing through the porous member, a fluid having sufficiently high viscosity that it will not pass through the porous member, and dry flowable particulate material.

Where the second flowable material is a fluid then, preferably, the intermediate product including foam and the second fluid are co-extruded into an outlet passage in which they are brought into contact with each other, preferably, to coalesce in the outlet passage. Additionally, after co-extrusion of the intermediate product including foam and the second fluid, the intermediate product including foam and the second fluid may be subjected to some intermixing in the outlet passage.

The intermediate product including foam and the second fluid are preferably co-extruded as extruded streams in a parallel direction with one of the streams being annular about the other stream. Preferably, the intermediate product including the foam is extruded annularly about the other stream comprising the second fluid.

Preferably, the extrusion of both the first fluid by itself, or with air through a porous member, and the dispensing and/or extrusion of the second flowable material are carried out by the movement of a single piston member within a piston chamber forming element. The single piston member and the piston chamber forming element preferably define therebetween a first fluid chamber having an inlet in communication with a first reservoir and an outlet, and a second chamber for the flowable material having an inlet in communication with a second reservoir. When the piston member is reciprocally moved in the piston chamber member, the first fluid is drawn into and forced out of the first fluid chamber and the second flowable material is dispensed from the second chamber and the two streams are provided together to a user. When the first fluid is to be foamed, the single piston member and piston chamber also define therebetween an air chamber having an air inlet and an air outlet. When the piston member is reciprocally moved in the piston chamber member, air is drawn into and forced out of the air chamber, the first fluid is drawn into and forced out of the first fluid chamber and the second flowable material is dispensed from the second chamber. The air and first fluid are mixed and passed through a foam-inducing device to provide an intermediate foamed product. The second flowable material is delivered with the intermediate foamed product to a user.

A wide variety of different combinations of known pumps can be adapted to provide a dispenser in accordance with the present invention.

For example, as a pump to dispense and extrude a fluid which may or may not comprise particulate matter or high viscosity liquids, two or three piece pumps incorporating one-way valves which may or may not have different size cylinders, may be utilized as disclosed, for example, in the applicant's U.S. Pat. No. 5,282,522 to Ophardt, issued Feb. 1, 1994, the disclosure of which is incorporated herein by reference. As to the nature of pumps which can be adopted for use in mixing air and a liquid capable of foaming to provide a foamed intermediate product, pumps of the type disclosed in the present applicant's U.S. Pat. No. 6,409,050, issued Jun. 25, 2002 to Ophardt et al., and U.S. Pat. Nos. 5,445,288 and 6,082,586 to Banks can be adopted. In accordance with the preferred embodiments, the piston and the complimentary piston chamber forming member as is used in previously known devices for producing a foamed intermediate product is modified so as to provide an additional pump mechanism to simultaneously dispense a second flowable material simultaneously with dispensing the foamed intermediate product.

Preferred pumping mechanisms may provide as between a single piston and a single piston chamber forming member, a separate pumping chamber and/or pumping capability for each of a first fluid and a second flowable material and, optionally, air when the first fluid is capable of foaming. Preferably, each of the two or three of these chambers is co-axially disposed relative to the piston and piston chamber. As in the manner of previously known dispensing devices, the piston may be reciprocally moved relative the piston chamber-forming member to pump or dispense from each chamber. Reciprocal movement of the piston may be accomplished by a manually activated lever as in the manner of known soap dispensers.

Known soap dispensers include disposable reservoirs carrying a disposable pump which are adapted for placement and replacement inside a permanent dispenser housing. In accordance with the present invention, a new disposable reservoir assembly including a disposable pump, may be provided for replacement in existing known dispensers, however, with the new reservoir incorporating two reservoir chambers, one for a first liquid which may be capable of being foamed and the second for a second flowable material, for example, to include particulate matter.

BRIEF DESCRIPTION OF THE DRAWINGS

FIG. 3 is a cross-sectional view through the extruded product of FIG. 1 along section line 3-3';

FIG. 4 is a view the same as in FIG. 3 but with different grit liquid extrudates;

FIG. 5 is a schematic pictorial representation of reservoirs for use with dispensers in accordance with the present invention in which one reservoir is internal of the second reservoir;

FIG. 6 is a view of an alternate reservoir arrangement in which the two reservoirs are stacked on top of each other;

FIG. 7 is a schematic pictorial view of an alternate arrangement of reservoirs in which the reservoirs are side by side;

FIG. 8 is a schematic cross-sectional side view through a reservoir formed from flexible sheeting in which the same sheet forming an outside wall of an interior wall forms an inside wall of an exterior reservoir;

DETAILED DESCRIPTION OF THE DRAWINGS

Figure 1:
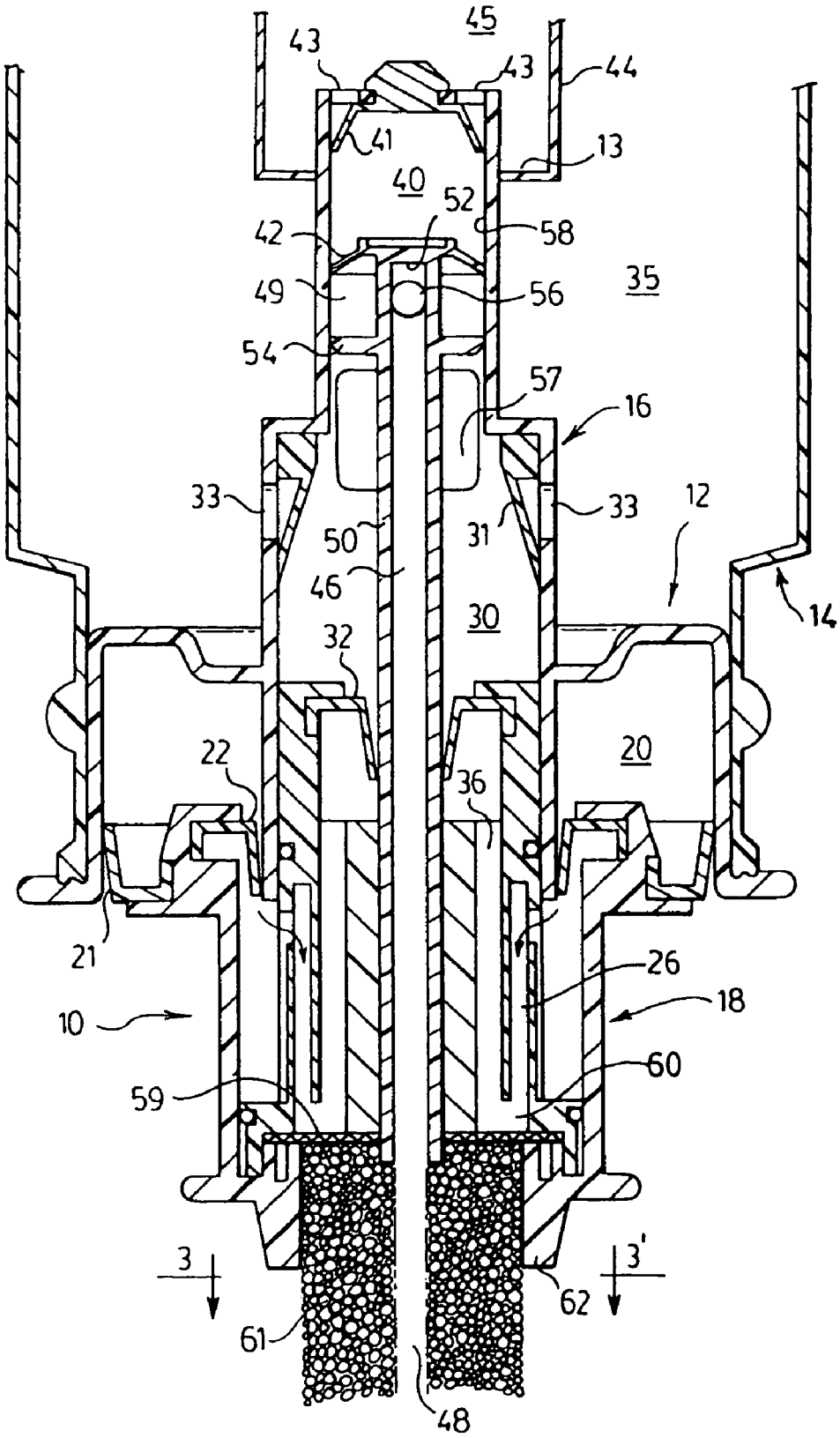
FIG. 1 is a schematic cross-sectional side view of a first embodiment of a dispenser in accordance with the present invention.

Reference is made to FIG. 1 which illustrates a first preferred embodiment in accordance with the present invention.

A pump mechanism generally indicated 10 is secured in the opening 12 of a first reservoir 14 only schematically. The pump mechanism 10 comprises a piston chamber-forming member 16 within which a piston 18 is coaxially slidable.

Three chambers are formed between the piston chamber forming member 16 and the piston 18. These three chambers include an air chamber 20, a foam liquid chamber 30 and a grit liquid chamber 40. Each of these chambers has a one-way inlet valve and a one-way outlet valve. The air chamber 20 has one-way inlet valve 21 with a flexible annular flange which is biased radially outwardly and deflects radially inwardly to permit air to enter the chamber 20. One-way air outlet valve 22 has a similar flexible annular flange biased radially inwardly, and which deflects radially outwardly to permit air to exit from the air chamber 20. The air inlet valve 21 and air outlet valve 22 are carried on the piston 18.

Foam liquid chamber 30 is in fluid communication with the interior of the reservoir 14 via an inlet 33. A one-way foam liquid inlet valve 31 has a flexible annular flange which is biased radially outwardly and deflects radially inwardly to permit foam fluid 35 from the reservoir 14 to enter the foam liquid chamber 30. A one-way foam liquid outlet valve 32 has a flexible annular flange which is biased radially inwardly and deflects radially outwardly to permit foam liquid to exit the foam liquid chamber 30. The foam liquid inlet valve 31 is carried on the piston chamber forming member 16. The foam liquid outlet valve 32 is carried on the piston 18.

The piston chamber-forming member 16 is connected at its upper end to a second reservoir 44 only schematically shown carrying the grit liquid 45. The second reservoir 44 is preferably collapsible and formed for example as a bag with a mouth adapted to be secured to the piston chamber-forming member 16.

The grit liquid chamber 40 has inlets 43 there into which permits grit fluid 45 from within the second reservoir 44 to enter via inlets 43 into the grit liquid chamber 40 past one-way grit liquid inlet valve 41 which has a flexible annular flange secured to the piston chamber forming member 16 which is biased radially outwardly and deflects radially inwardly to permit grit liquid 45 to flow into the grit liquid chamber 40.

The piston 18 carries a one-way grit liquid exit valve 42 which has a flexible annular flange which is biased radially outwardly and deflects radially inwardly to permit grit liquid to exit the grit liquid chamber 40.

The piston 18 has a central hollow grit delivery tube 50 with a grit delivery passageway 46 co-axially disposed therein extending from a closed inner end 52 proximate the grit liquid exit valve 42 to an open grit liquid outlet 53. A sealing flange 54 is carried on the grit delivery tube 50 spaced from the grit liquid exit valve 42 which sealing flange 54 prevents fluid flow axially there past in either direction. A radially extending opening 56 extends from an annular space 49 between grit liquid one-way valve 42 and the sealing flange 54 to the grit delivery passageway 46.

Reciprocal movement of the piston 18 within the piston chamber forming mechanism will cause grit liquid 45 to successively be drawn from the second reservoir 44 into the grit liquid chamber 40 and hence dispense or otherwise be extruded past the one-way grit liquid exit valve 42 through the radially extending opening 56 into the grit delivery passageway 46 and subsequently to exit out the grit liquid outlet 53. Vanes 57 are preferably provided on the grit delivery tube 50 to assist in locating the piston 18 coaxially within an inner cylindrical sidewall 58 of the piston chamber forming member 16 which forms the grit liquid chamber 40.

Referring to the foam liquid chamber 30, with movement of the piston 18 reciprocally inwardly and outwardly relative the piston chamber forming member 16, foam liquid 35 is drawn into the foam liquid chamber 30 via inlet openings 33 past the foam liquid inlet valve 31 and is dispensed or extruded past the foam liquid outlet valve 32 to be extruded through a foam liquid delivery passageway 36 to a location where the foam liquid delivery passageway 36 joins with a air delivery passageway 26.

Referring to the air chamber, with movement of the piston 18 reciprocally inwardly and outwardly relative the piston chamber forming member 16, air is drawn into the air chamber 20 past air inlet valve 21 and is expelled from the air chamber 20 past air outlet valve 22 via the air delivery passageway 26 which merges with the liquid delivery passageway 36 at an annular mixing chamber 60 disposed adjacent an annular porous member 59 carried by the piston 18 about the grit delivery tube 50. Expelled air and extruded foam liquid from the mixing chamber 60 are forced through the porous member 59 so as to be extruded through the porous member 59 providing a foamed intermediate product schematically indicated as 61 comprising air, the foam liquid and foam formed therefrom.

Simultaneously with the foamed intermediate product 61 being extruded from the outlet side of the annular porous member 59, grit liquid 45 is extruded from the grit delivery passageway 46 out of the grit liquid outlet 53. The grit liquid 45 as it exits the grit liquid outlet 53 is a cylindrical extrudate 48 schematically shown with the foamed intermediate product 61 as an annular extrudate thereabout as best seen in FIG. 3. The piston 18 has an outlet tube 62 which extends axially from the porous member 59 and the grit delivery tube 50 and provides an outlet passageway of an axial length which can be of assistance in facilitating contesting, constraining, coalescing, adhering and/or mixing of the foamed intermediate product 61 and the grit liquid extrudate 48 as they are co-extruded through the outlet passageway.

The nature of the first reservoir 14 is not limited and it may comprise an open topped or closed container and, if closed, may be either a vented rigid container or a collapsible container. Similarly, the nature of grit reservoir 44 is not limited and it may comprise an open topped or closed container and, if closed, may be either a collapsible container or a vented rigid container which may be internal of the first reservoir.

Figure 2:
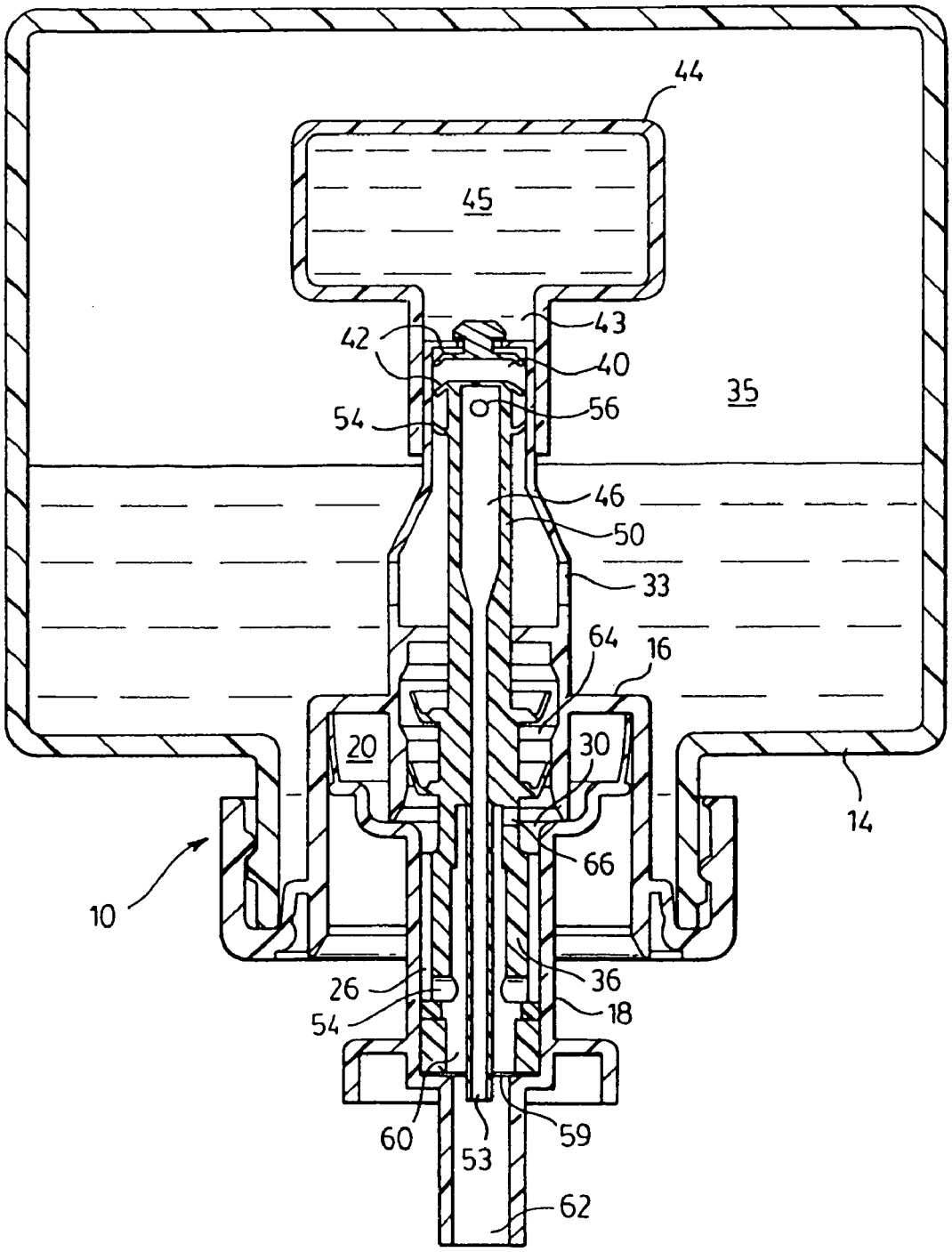
FIG. 2 is a cross-sectional side view of a second embodiment of a dispenser in accordance with the present invention.

Reference is made to FIG. 2 which shows a second embodiment of a dispenser according to the present invention. The same reference numerals are used in FIG. 2 as in FIG. 1 to indicate similar elements. Like FIG. 1, FIG. 2 schematically illustrates a combination of a first dispenser for dispensing air and a foamable liquid to produce a foamed intermediate product and a second dispenser to simultaneously dispense a second fluid. The first dispenser to produce a foamed intermediate product is of the type disclosed in the present applicant's U.S. Pat. No. 6,409,050 to mix air with a foam liquid 35 from reservoir 14 but modified to provide at the inner end of the piston chamber forming member 16 and the piston 18 an addition pump of the type disclosed in the applicant's U.S. Pat. No. 5,282,552 to dispense a second liquid 45 from a second reservoir 44.

In FIG. 2, referring to the air chamber 20, with reciprocal movement of the piston 18, air is drawn into the air chamber 20 and effectively is caused to exit via air delivery passageway 26 leading to radially inwardly delivery port 54. The foam liquid chamber 30 is a chamber to which foam liquid 35 may enter with movement of the piston 18 from the first reservoir 14 via foam liquid inlet 33 and be directed through an intermediate chamber 64 to the foam liquid chamber 30 from which it is dispensed notably via a radial outlet 66 to an annular foam liquid delivery passageway 36 which merges with air from the air delivery passageway 26 and its delivery port 54 in an annular mixing chamber 60 above annular porous screen 59 such that the air and foam liquid are together forced through the porous screen 59 to provide a foamed intermediate product in the outlet tube 62.

The pump assembly for extruding the grit liquid is substantially the same in FIG. 2 as that in FIG. 1. Grit liquid 45 enters the grit liquid chamber 40 via inlet 43 and is extruded with movement of the piston 18 to pass through the grit liquid delivery passageway 46 of the central grit liquid delivery tube 50 and out outlet 53.

The foamed intermediate product formed from the air and foam liquid is extruded through the screen 59 into the outlet tube 62 annularly about the grit liquid delivery tube 50 while the grit liquid 45 is simultaneously extruded from grit liquid delivery tube 50 into the outlet tube 62.

Both the embodiments of FIGS. 1 and 2 illustrate the outlets for the foamed intermediate product and the grit liquid being co-axial with the foamed intermediate product extruded annularly about the grit liquid extrudate 48. This is preferred but not necessary. The FIGS. 1 and 2 also show the foamed intermediate product and the grit liquid being extruded in the identical axially direction. This is not necessary. The intermediate foamed product and the grit liquid extrudate could be extruded merely side to side or at different locations of the outlet tube or for example with the grit liquid extrudate annularly about the foamed intermediate product or merely at some location preferably adjacent thereto. As another preferred embodiment, the outlet 53 of the grit liquid delivery tube 50 may split the grit liquid extrudate into a plurality of streams say four streams 48 radially and circumferentially spaced within the outlet tube 65 as shown in FIG.

4 to increase contact and coalescence between the foamed intermediate product 61 and the extrudate 48.

In the preferred embodiments of FIGS. 1 and 2, the pump mechanism is illustrated as having three separate chambers, each adapted to receive and expel three different fluids namely air, the foam liquid and the grit liquid. Providing the three chambers to be formed between merely two members namely the piston chamber-forming member 16 and the piston 18 is preferred, however, is not necessary. Two separate pump assemblies could be provided for pumping in parallel as by a single actuator with the outlets of each, namely, the outlet of a foaming pump providing the foamed intermediate product and the outlet of a separate grit liquid pump being coupled so as to co-extrude the foamed intermediate product and the grit liquid extrudate at the same location.

Providing the two reservoirs 14 and 44 such that one reservoir is interior of the other is not necessary. The reservoirs may be individual separate reservoirs provided that the inlets for the respective liquids to be pumped, namely, the foaming liquid and the grit liquid are in communication with the inlets to the respective foam liquid chamber and grit liquid chamber. Reference is made to FIGS. 5 to 8 which schematically illustrate a number of different arrangements by which two reservoirs 14 and 44 may be provided as adapted, for example, for use with either of the pumps illustrated in FIGS. 1 and 2. In this regard, FIG. 5 illustrates two separate reservoirs as in the manner shown in FIG. 2 with reservoir 44 being separate from and internally provided inside the reservoir 14 with an opening 12 of the reservoir 14 to engage about the exterior of the air chamber shown in FIGS. 1 and 2 and an outlet 13 of the chamber 44 to engage about the outer side wall 58 of the inner portion of the piston chamber forming member 16 shown in FIGS. 1 and 2.

Reference is made to FIG. 6 which illustrates the reservoir 14 as being annular with a central passageway therethrough. The reservoir 44 is stacked vertically above the reservoir 14. The reservoir 44 has its outlet 13 adapted to engage about the cylindrical side wall 58 of the piston chamber forming member 16 of FIG. 1 or 2. The reservoir 14 has an annular outlet 12 adapted to be secured about the flange about the air chamber 20 shown in FIGS. 1 and 2.

Referring to FIG. 7, the containers 14 and 44 are disposed to be arranged side to side in abutting relation although they are shown spaced for simplicity of illustration in FIG. 7. Each carries a portion of a cylindrical coupling for securing to the pump with selective openings to be provided, for example, to suitably connect the fluid in the reservoir 14 to the chamber 30 shown in FIGS. 1 and 2 and to suitably connect the reservoir 44 to the chamber 40 shown in FIGS. 1 and 2.

FIG. 8 illustrates a schematic cross-section through a compound bag formed of flexible plastic sheeting and adapted to have lower ends form outlet 12 for securing about the air chamber 20, shown in FIGS. 1 and 2, and inner sheets adapted for securing about the cylindrical portion 58, shown in FIGS. 1 and 2. The flexible sheet which forms the exterior wall of the reservoir 44 forms an interior wall of the reservoir 14. The sheets may be closed at their upper end as, for example, along a common upper weld joint. Many other modifications and variations will occur to persons skilled in the art.

In the embodiments of FIGS. 1 and 2, the liquid in the second reservoir 44 has been referred to as a grit liquid. It is to be appreciated that, in accordance with the invention, the grit liquid is not to be limited merely to liquids containing grit. While grit liquid is normally to be interpreted as meaning liquid containing example solid particular matter, the grit liquid may be replaced by any liquid which may be desired as, for example, a liquid with high viscosity which would not conveniently pass through the porous member or any other liquid which is not desired to be mixed with the foam liquid until after foam has been formed.

Figure 9:
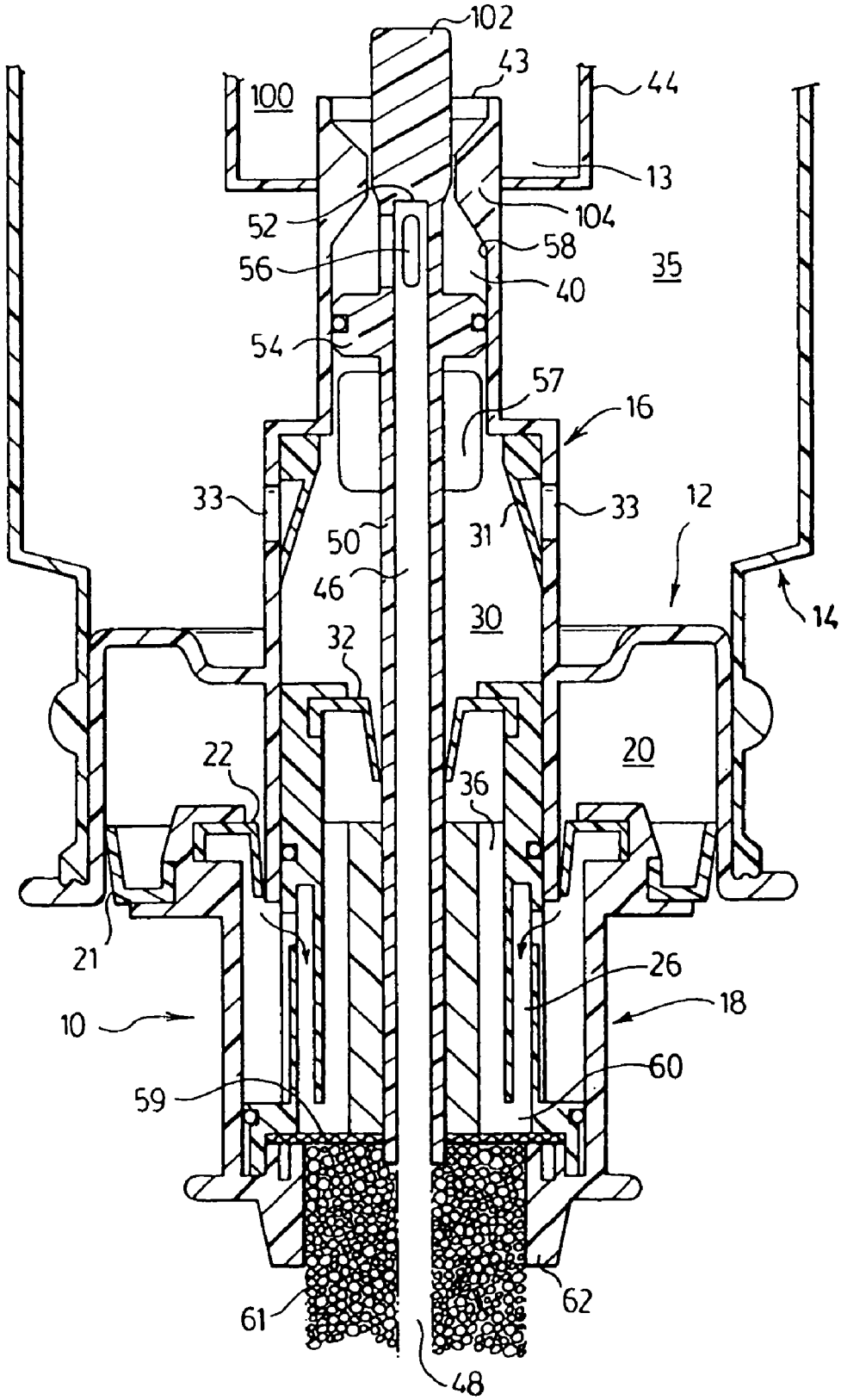
FIG. 9 is a cross-sectional side view of a third embodiment of a dispenser in accordance with the present invention in an extended position.

Reference is made to FIG. 9 which shows a third embodiment of a pump mechanism 10 which is identical to that shown in FIG. 1 but for the replacement of the liquid pump to pump grit liquid 45 from the second reservoir 44 with a gravity flow dispenser to dispense dry flowable particulate material indicated as 100 in FIG. 9 from the second reservoir 44. As seen in FIG. 9, the delivery tube 50 carries at its closed inner end 52, a stopper member 102. Sealing flange 54 has been expanded axially and includes a sealing O-ring for sealing with the inner side wall 58 of the piston chamber forming member 16 which forms the chamber 40. Radially extending openings 56 extend through the delivery tube 50 to permit the particulate material 100 to flow from the chamber 40 into the delivery passageway 46 and, hence, out the outlet 53.

The delivery tube 50 carries a radially inwardly extending annular valve seat 104 near its inlet 43 which cooperates with the stopper member 102 to permit particulate material 100 in the reservoir 44 to flow under gravity down into chamber 40 with reciprocal movement of the piston 18 inwardly and outwardly relative the piston chamber forming member 16.

FIG. 9 illustrates the piston 18 in an extended position in which the stopper member 102 engages or is sufficiently proximate to the valve seat 104 to close the inlet 43 and prevent flow down into chamber 40.

Figure 10:
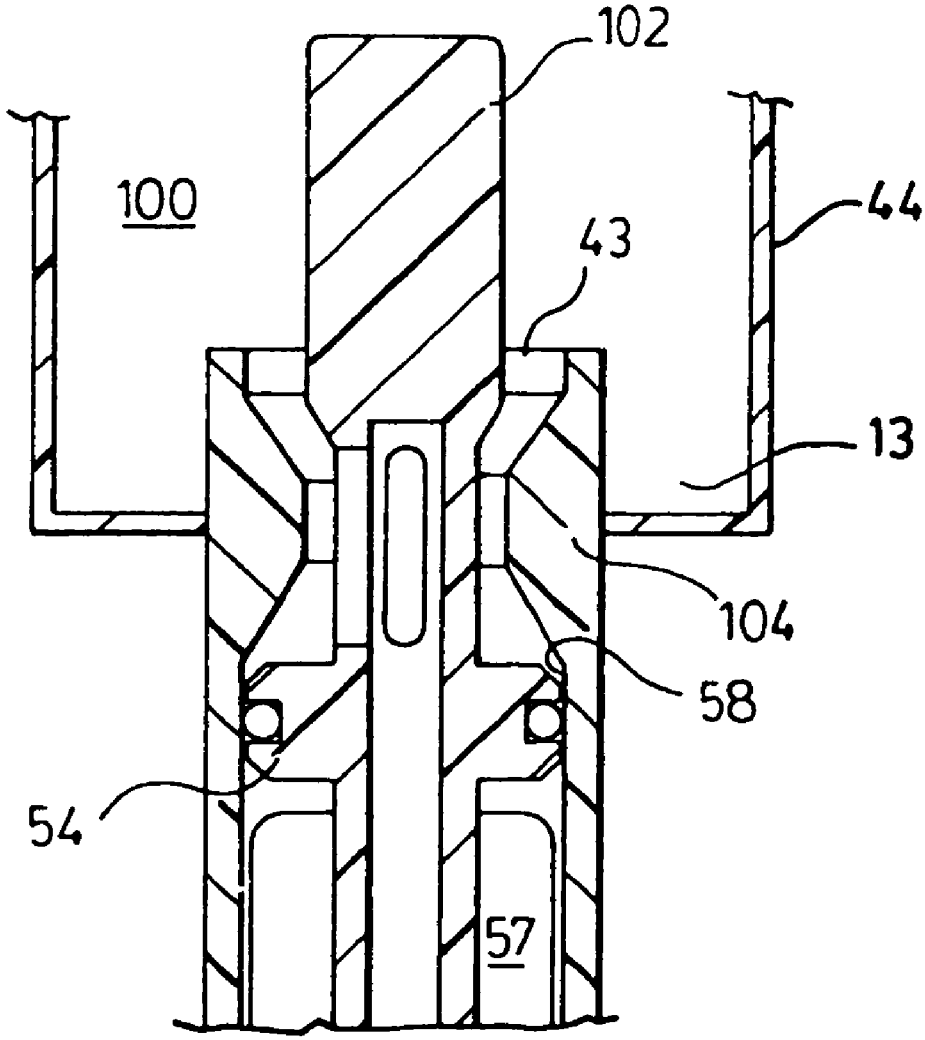
FIG. 10 is a cross-sectional side view of the stopper valve assembly of FIG. 9 but in a retracted position.

FIG. 10 illustrates the relative position of the stopper member 102 and valve seat 104 when the piston 18 is in a retracted position. The stopper member 102 is moved inwardly sufficiently that particulate matter 100 from second reservoir 44 is free to flow under gravity down into the chamber 40.

The axial length of the stopper member 102 and the relative size and position of the valve seat 104 can suitably be selected towards controlling the amount of particulate matter 100 which may flow into the chamber 40 with each stroke of the piston, and the relative timing as to when in the stroke the particulate material 100 may be dispensed. In any event, the particulate matter 100 is to be dispensed from the outlet 53 as 48 substantially simultaneously with dispensing of the foamed intermediate product 61 into the outlet passageway.

The openings 56 through the delivery tube 50 are enlarged to facilitate gravity flow of the particulate material 100 therethrough. In each stroke of reciprocally moving the piston 18 inwardly and outwardly, intermediate foam product 61 is dispensed into the outlet tube 62 at the same time that the particulate matter 100 is dispensed from the outlet 53. The foamed intermediate product 61 and dispensed particulate matter 48 are delivered by the outlet 62 together as to the hand of a person.

The embodiment of FIG. 9 has the air chamber 20, foamable liquid chamber 30 and the chamber 40 all coaxial.

Figure 11:
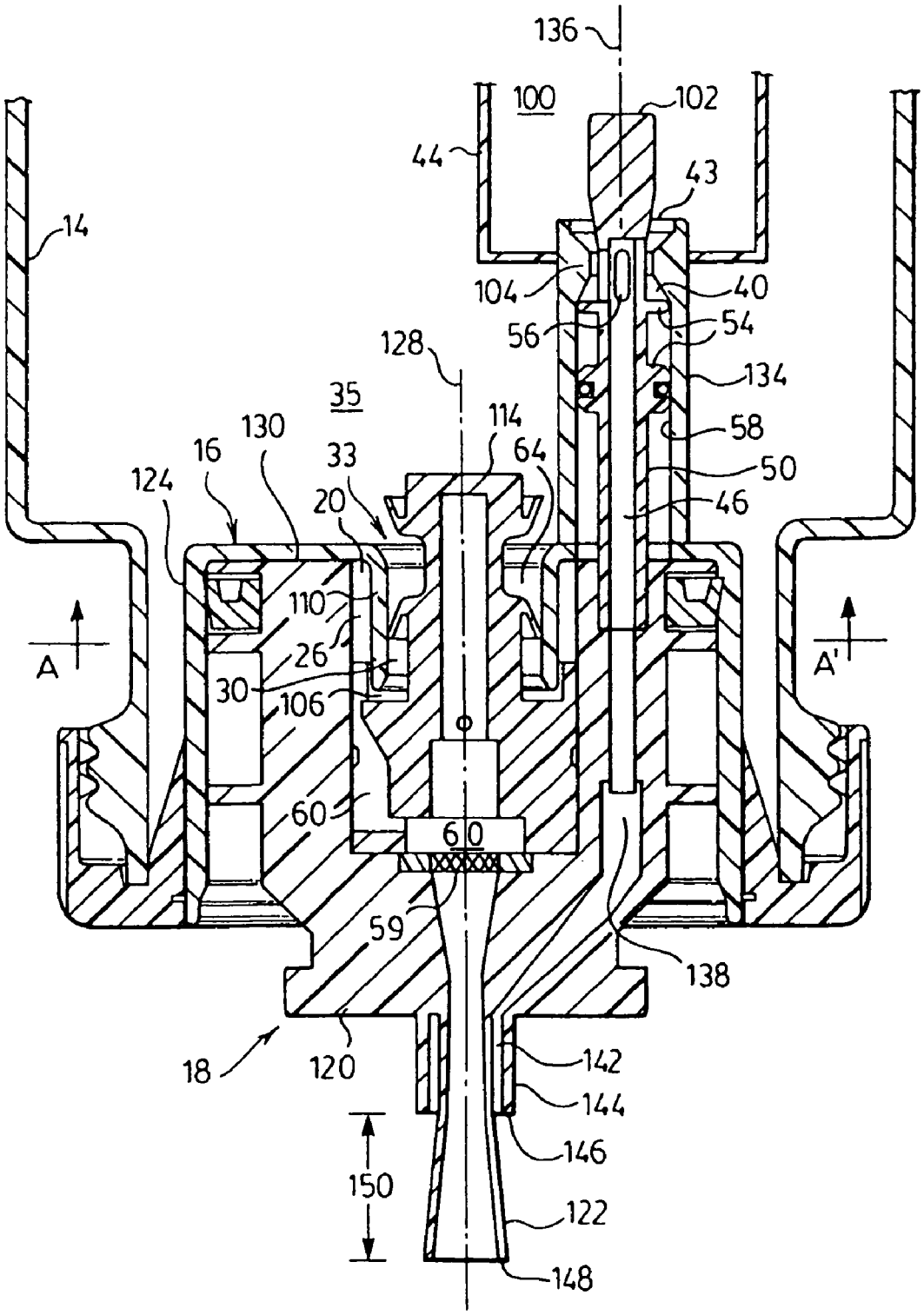
FIG. 11 is a cross-sectional side view of a fourth embodiment of a dispenser in accordance with the present invention in a retracted position.
Figure 12:
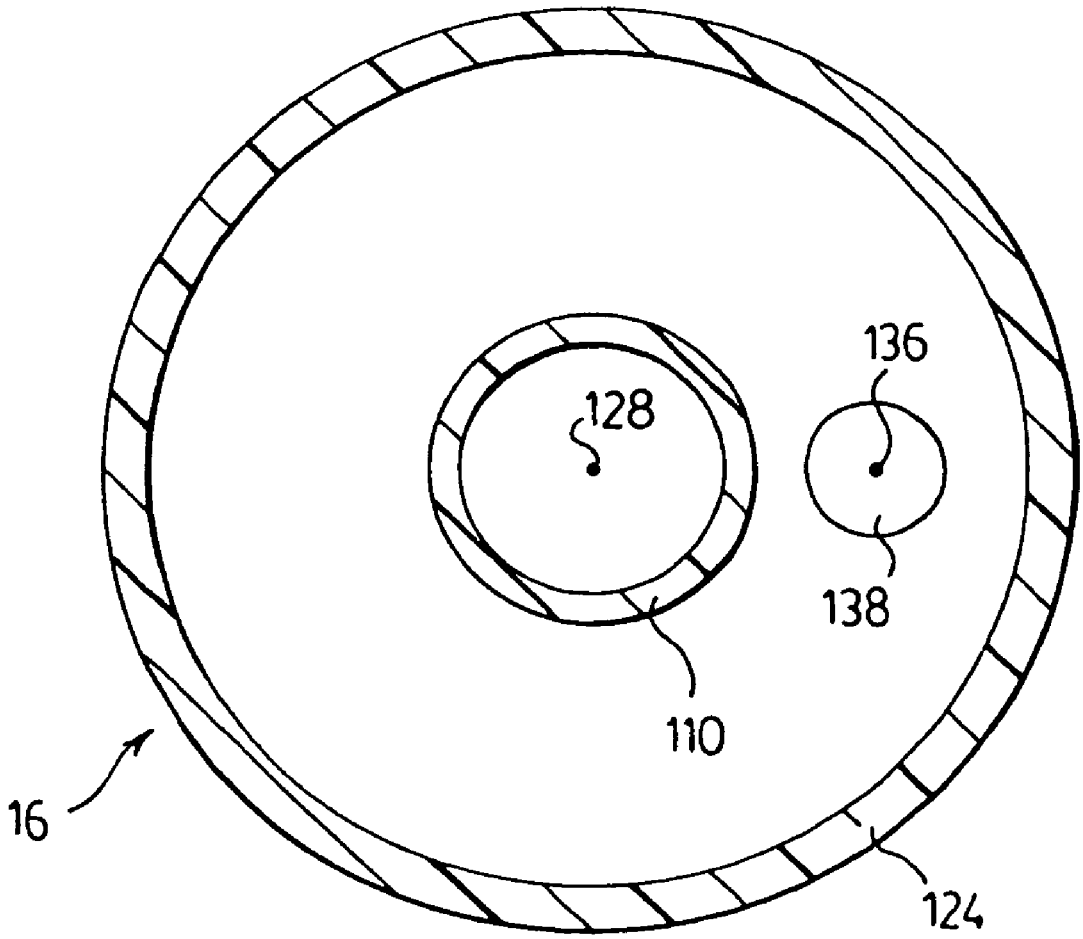
FIG. 12 is a cross-sectional view along section line A-A' of FIG. 11 but merely showing the piston chamber forming member.

Reference is made to FIGS. 11 and 12 which illustrate a fourth embodiment of a pump mechanism 10 in accordance with the present invention. The pump mechanism 10 of FIG. 11 utilizes a foaming pump of a type similar to that in FIG. 2 and described in U.S. Pat. No. 6,409,050 and includes a stopper type dispenser similar to that shown in FIG. 9 to dispense flowable particulate material 100 from the second reservoir 44.

In FIGS. 11 and 12, the same numerals are used as in the previous Figures to indicate similar elements.

Piston 18 is slidable into and out of the piston chamber-forming member 16. The piston 18 and piston chamber-forming member 16 define therebetween an air chamber 20 from which air is caused to exit via air delivery passageway 26 leading to mixing chamber 60 above porous member 59. The piston 18 and chamber-forming member 16 also define a foam liquid chamber 30 therebetween into which foam liquid 35 may enter from the first reservoir 14 via foam liquid inlet 33 and be directed to intermediate chamber 64 and, hence, to the foam liquid chamber 30 from which the foam liquid is dispensed radially outwardly via the axial gap 106 between an outer end of an inner cylindrical wall 110 of piston chamber forming member 16 and an inwardly directed shoulder of the piston 18 and, hence, to the mixing chamber 60. The mixing chamber 60 in FIG. 11 is formed as one or more axially extending slots in the outside of a central piston plug 114 secured inside a central bore of an outer annular piston body 120. Hence, on a retraction stroke, air and foaming liquid are forced into the mixing chamber 60, through the porous member 59 to form a foamed intermediate product extruded out an inner outlet tube 122 exiting to atmosphere at the lower end of the tube 122. Air may enter the air chamber 20 during a withdrawal of the piston 18 by passing upward through the outlet tube 122, porous member 59 and mixing chamber 60.

The piston chamber forming member 16 has an outer cylindrical wall 124 and an inner cylindrical wall 110 coaxial about a center axis 128, joined by an end wall 130 and adapted to coaxially slidably receive the piston body 120 and central piston plug 114 coaxially therein.

A circular opening 138 is provided through the end wall 130 radially between the walls 110 and 124 as best seen in FIG. 12. The piston chamber forming member 16 includes a tube member 134 which extends about an axis 136 parallel to axis 128 inwardly from the opening 132 to define the chamber 40 therein. The tube member 134 is open at its inlet 43 into communication with the second reservoir 44 carrying dry, flowable particulate material 100. Proximate its inlet 43, the tube member 43 carries a radially inwardly extending annular valve seat 104.

The annular piston body 120 carries a hollow delivery tube 50 which extends coaxially into the tube member 134 of the chamber forming member 16 and is axially slidable therein.

The delivery tube 50 carries at its inner end a stopper member 102 which is adapted to cooperate with the valve seat 104.

The delivery tube 50 carries sealing flanges 54 for sealing with the inner side wall 58 of the tube member 134. The delivery tube 50 has an internal delivery passageway 46 centrally therethrough with openings 56 through the delivery tube 50 to permit particulate matter 100 to flow from the chamber 40 into the internal delivery passageway 46.

The internal delivery passageway 46 of the delivery tube 50 communicates with a delivery passageway 138 which extends through the annular piston body 120 into an annular outletway 142 defined annularly about outlet tube 122 between the inner outlet tube 122 and an outer tube 144.

The outer tube 144 and therefore the outletway 142 have a lower end 146 which is spaced upwardly from the lower end 148 of the inner outlet tube 122. Dry particulate material 100 which is dispensed into the atmosphere from the outletway 142 dropping under gravity from the outlet at the lower end 146 of the outer tube 144 about the outside of the inner outlet tube 122 and past the lower end 148 of the inner outlet tube 122 where the particulate material 100 may with the foamed intermediate product, be received as on a hand of a user for use. Having a vertical gap indicated as 150 between the outletway 142 for the particulate material 100 and the outlet 148 for the foamed intermediate product assist in ensuring that liquid from the outlet 148 does not enter the outletway 142 and cause the particulate material 100 to clog the outletway 142.

The construction and operation of the stopper valve mechanism in FIGS. 11 and 12 is substantially the same as in FIG. 9 but shifted in FIGS. 11 and 12 to not be concentric with the remainder of the piston 18.

Figure 13:
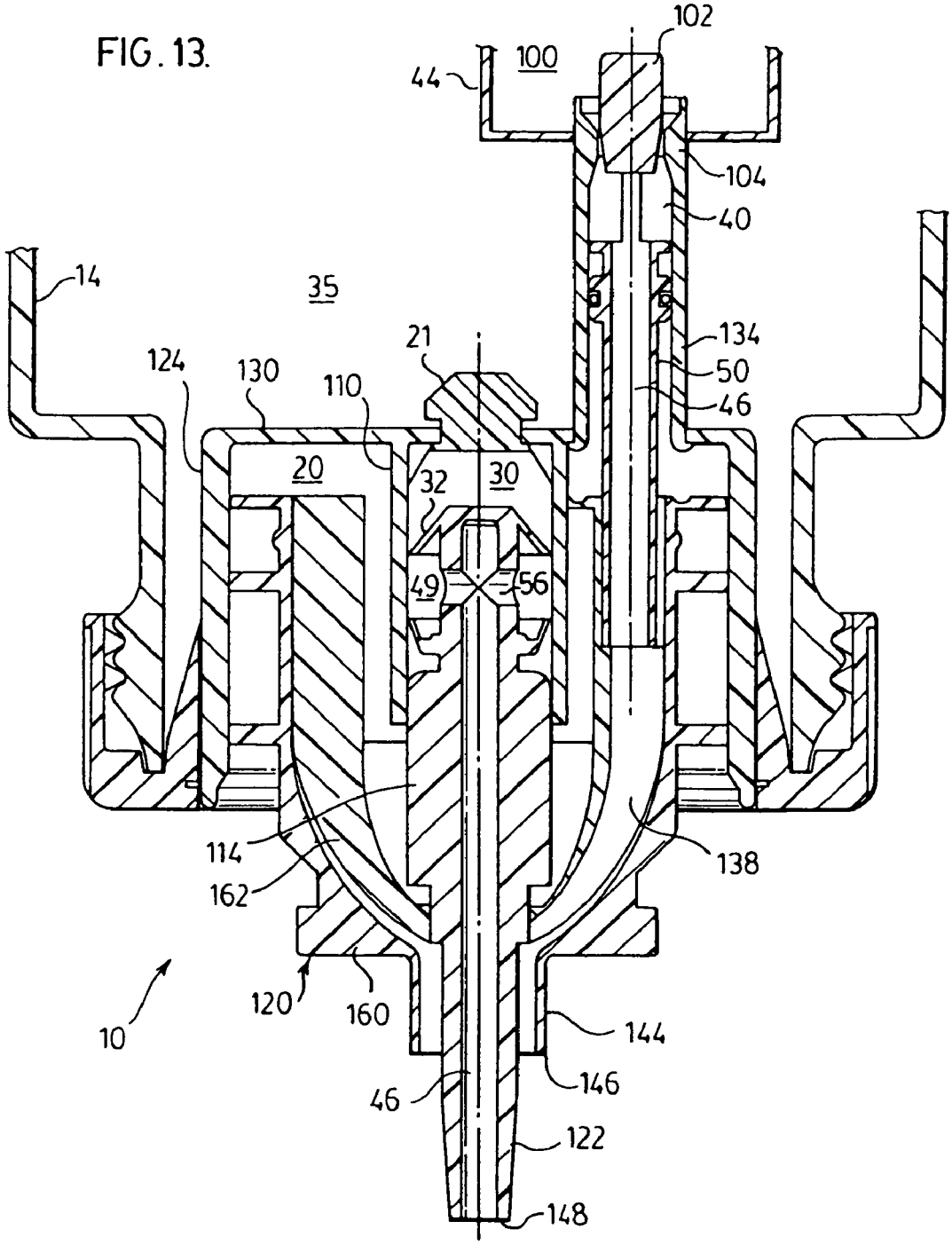
FIG. 13 is a cross-sectional side view of a fifth embodiment of a dispenser in accordance with the present invention in an extended position.
Figure 14:
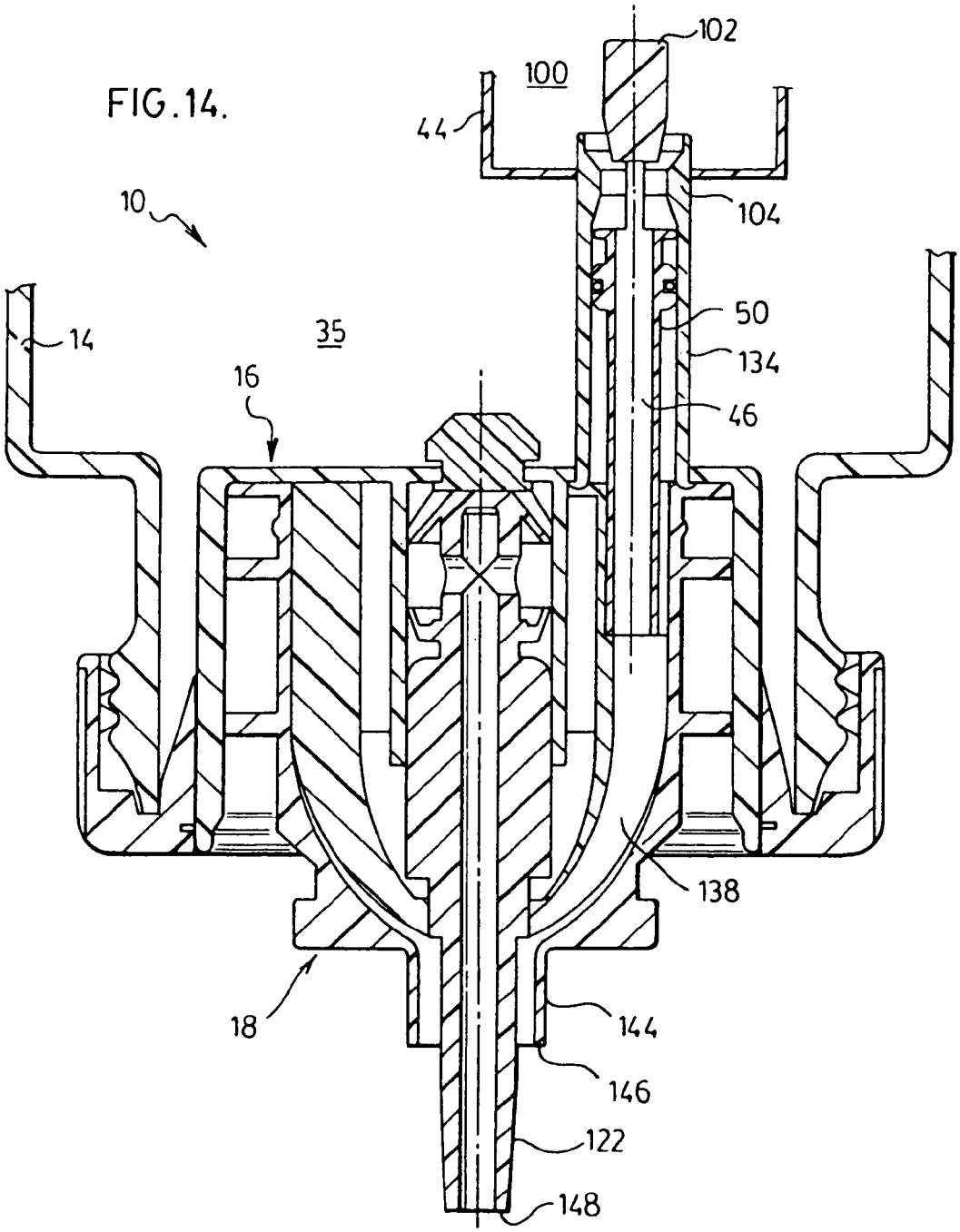
FIG. 14 is a cross-sectional view of the embodiment of FIG. 13 but in a retracted position.

Reference is made to FIGS. 13 and 14 which illustrate a fifth embodiment of a pump mechanism 10 in accordance with the present invention.

The embodiment of FIGS. 13 and 14 has a general configuration and operation which is the same as that in FIGS. 11 and 12, however, the pump carried coaxially in the piston 18 is adapted to dispense fluid without foaming it and, therefore, there is no provision of an air chamber. Rather, the pump to pump fluid 35 from the first reservoir 14 in FIGS. 13 and 14 is of the type used in FIG. 1 to pump fluid from the second reservoir 44.

In FIGS. 13 and 14, the annular piston body 120 is formed by two annular elements 160 and 162 such that the delivery passageway 138 may be formed therebetween. The arrangement and operation of the stopper delivery system for dispensing the particulate material 100 from the second reservoir 44 is substantially identical to that in FIG. 11.

A chamber indicated as 20 in FIG. 13 which could form an air chamber may be vented to atmosphere as by not sealing between the piston 18 to the inside of the outer wall 124 of the piston chamber forming member 16.

The embodiments of FIGS. 9, 11 and 13 are shown to dispense particulate material 100 from the second reservoir 44. Such particulate material 100 may comprise any material which is capable of flowing under gravity as would be the case with dry powders, sand, dry pellets and the like. Such particulate materials 100 include those particulate solid materials which may be desired to be added to fluids such as cleaning fluids and hand cleaners such as grit, pumice, silica and the like. However, other particulate solid materials may be used as, for example, solid materials which are not to contact fluids until use.

Each of the embodiments are particularly adapted to provide a soap dispenser mechanism which is readily adapted for use in known soap dispensers such as wall mounted soap dispensers disclosed in the applicant's U.S. Pat. No. 5,373,970, issued Dec. 20, 1994, the disclosure of which is incorporated herein. The structure comprising in combination the first reservoir 14 and a second reservoir 44 can conveniently be arranged to have a shape and/or size adapted for direct substitution for an existing reservoir. The external mechanism of the pump assembly and particularly the piston as adapted to be coupled to an actuating mechanism may be identical to that for the dispenser and, therefore, a dispenser reservoir with pump in accordance with this invention can be readily adapted for use in existing dispenser housings by replacement of known soap reservoirs carrying integral pumps.

Many modifications and variations will now occur to persons skilled in the art. For a definition of the invention reference is made to the following claims.

We claim:

1. A dispensing pump comprising:

a first reservoir with a first fluid;

a second reservoir with a dry particulate solid flowable material capable of flowing under gravity, a vertical fluid dispensing tube having a lower end for dispensing the fluid downwardly, and a flowable material outlet disposed about the fluid dispensing tube adjacent thereto at a height above the lower end of the fluid dispensing tube for simultaneously dispensing the flowable material downwardly therefrom, a single piston member within a piston chamber-forming element defining therebetween a first fluid chamber having an inlet in communication with the first reservoir and the fluid dispensing tube as an outlet and a flowable material chamber having an inlet in communication with the second reservoir and an outlet in communication with the flowable material outlet, the piston member reciprocally movable in the piston chamber-forming element and in movement in a first direction, the first fluid is drawn into the first fluid chamber and the inlet to the flowable material chamber is opened and in movement in the opposite direction, the first fluid is expelled from the fluid dispensing tube and the inlet to the flowable material chamber is closed, reciprocal movement of the piston member in the piston chamber-forming element simultaneously extruding the first fluid from the lower end of the fluid dispensing tube and the flowable material from the solid material outlet.

2. A pump as claimed in claim 1 wherein the flowable material outlet is annular about the fluid dispensing tube.

3. A pump as claimed in claim 1 wherein:

the first fluid is capable of foaming; and the pump further including:

a porous member between the first reservoir and the lower end of the fluid dispensing tube, and an air pump to pressurize atmosphere air and simultaneously pass air and the first fluid through the porous member to produce an intermediate product to be dispensed out the lower end of the fluid dispensing tube.

4. A pump as claimed in claim 1 wherein flowable material is selected from the group comprising grit, pumice, plastic synthetic resin scrubber particles, wood powder, ground sponge, ground cork and finely divided silica.

5. A pump as claimed in claim 2 wherein the flowable material is selected from the group comprising grit, pumice, plastic synthetic resin scrubber particles, wood powder, ground sponge, ground cork and finely divided silica.

6. A pump as claimed in claim 3 wherein the flowable material outlet is annular about the fluid dispensing tube.

7. A pump as claimed in claim 3 wherein the second fluid is a fluid comprising solid particulate material which will not pass through the porous member and the solid particulate material is selected from the group comprising grit, pumice, plastic synthetic resin scrubber particles, wood powder, ground sponge, ground cork and finely divided silica.

8. A dispensing pump comprising:

a first reservoir with a first fluid;

a second reservoir with a flowable material comprising a second fluid capable of flowing under gravity, a vertical fluid dispensing tube having a lower end for dispensing the first fluid downwardly, and a flowable material outlet disposed about the fluid dispensing tube adjacent thereto at a height above the lower end of the fluid dispensing tube for simultaneously dispensing the flowable material downwardly therefrom, the first fluid is a liquid capable of foaming;

a porous member between the first reservoir and the lower end of the fluid dispensing tube, a single piston member within a piston chamber-forming element defining therebetween an air chamber having an air inlet and an air outlet, a first fluid chamber having an inlet in communication with the first reservoir and an outlet, and a second fluid chamber having an inlet in communication with the second reservoir and wherein the piston member is reciprocally movable in the piston chamber forming element and in movement in a first direction, air is drawn into the air chamber, the first fluid is drawn into the first fluid chamber and the second fluid is drawn into the second fluid chamber and in movement in the opposite direction, air expelled from the air outlet of the air chamber, the first fluid is expelled from the outlet of the first fluid chamber and the second fluid is expelled from the outlet of the second fluid chamber, wherein the first fluid and air are pressurized and simultaneously passed through the porous member to produce an intermediate product including foam which is extruded out the lower end of the fluid dispensing tube, and the second fluid is simultaneously extruded out the flowable material outlet by the movement of the single piston member.

9. A pump as claimed in claim 8 wherein the second fluid is selected from a fluid comprising solid particulate material which will not pass through the porous member and a fluid having sufficiently high viscosity that it will not pass through the porous member.

10. A pump as claimed in claim 8 wherein the flowable material outlet is annular about the fluid dispensing tube.

11. A pump as claimed in claim 8 wherein the second fluid is a fluid comprising solid particulate material which will not pass through the porous member and the solid particulate material is selected from the group comprising grit, pumice, plastic synthetic resin scrubber particles, wood powder, ground sponge, ground cork and finely divided silica.

12. A pump as claimed in claim 11 wherein the flowable material outlet is annular about the fluid dispensing tube.

13. A dispensing pump comprising:

a first reservoir with a first fluid;

a second reservoir with a flowable material capable of flowing under gravity, a vertical fluid dispensing tube having a lower end for dispensing the first fluid downwardly, and a flowable material outlet disposed about the fluid dispensing tube adjacent thereto at a height above the lower end of the fluid dispensing tube for simultaneously dispensing the flowable material downwardly therefrom, the first fluid is a liquid capable of foaming;

a porous member between the first reservoir and the lower end of the fluid dispensing tube, the flowable material is selected from the group consisting of dry, solid particulate material, a fluid comprising solid particulate material which will not pass through the porous member and a fluid having sufficiently high viscosity that it will not pass through the porous member, a single piston member within a piston chamber-forming element defining therebetween an air chamber having an air inlet and an air outlet, a first liquid chamber having an inlet in communication with the first reservoir and an outlet, and a second fluid chamber having an inlet in communication with the second reservoir and wherein the piston member is reciprocally movable in the piston chamber forming element and in movement in a first direction, air is drawn into the air chamber, the first fluid is drawn into the first fluid chamber and the flowable material flows under gravity into the second fluid chamber and in movement in the opposite direction, air expelled from the air outlet of the air chamber, the first fluid is expelled from the outlet of the first fluid chamber and the flowable material is expelled from the outlet of the second fluid chamber, wherein the first fluid and air are pressurized and simultaneously passed through the porous member to produce an intermediate product including foam which is extruded out the lower end of the fluid dispensing tube, and the flowable material is simultaneously expelled out the flowable material outlet by the movement of the single piston member.

14. A pump as claimed in claim 13 wherein the solid particulate material is selected from the group comprising grit, pumice, plastic synthetic resin scrubber particles, wood powder, ground sponge, ground cork and finely divided silica.

15. A pump as claimed in claim 13 wherein the flowable material outlet is annular about the fluid dispensing tube.

16. A pump as claimed in claim 14 wherein the flowable material outlet is annular about the fluid dispensing tube.

* * * * *